United States Patent [19]

Crews

[11] 4,227,570

[45] Oct. 14, 1980

[54] HEAT EXCHANGE STRUCTURE

[75] Inventor: Donald R. Crews, Peoria, Ill.

[73] Assignee: Caterpillar Tractor Co., Peoria, Ill.

[21] Appl. No.: 95,195

[22] Filed: Oct. 1, 1979

[51] Int. Cl.[3] ..... F28F 9/26; F01P 11/08

[52] U.S. Cl. ..... 165/67; 165/140; 165/149; 165/174; 180/68 R

[58] Field of Search ..... 165/67, 140, 141, 149, 165/174; 180/68 R; 184/104 B; 248/232

[56] References Cited

U.S. PATENT DOCUMENTS

| | | | |
|---|---|---|---|
| 1,963,429 | 6/1934 | Young | 165/149 |
| 2,397,069 | 3/1946 | Young et al. | 165/140 |
| 2,506,051 | 5/1950 | Young | 165/149 |
| 2,796,239 | 6/1957 | Holmes et al. | 165/41 |
| 2,887,097 | 5/1959 | Huffman, Sr. et al. | 165/140 |
| 3,096,818 | 7/1963 | Evans et al. | 165/151 |
| 3,165,151 | 1/1965 | Astrup et al. | 165/149 |
| 3,265,126 | 8/1966 | Donaldson | 165/140 |
| 3,908,758 | 9/1975 | Armonies et al. | 165/174 |
| 3,983,932 | 10/1976 | Yamaguchi et al. | 165/140 |

*Primary Examiner*—Sheldon Richter

*Attorney, Agent, or Firm*—Wegner, Stellman, McCord, Wiles & Wood

[57] ABSTRACT

A heat exchange structure is provided wherein a radiator (10) has a cooling core (24) extending between a top tank (22) and a bottom tank (20) with the bottom tank (20) being open (38) at one side. A cooler (66) for cooling a second fluid is mounted on a plate (46) which is sealingly secured over the open side (38) of the bottom tank (20) to position the cooler (66) in said bottom tank (20). A baffle (55) is mounted in the bottom tank (20) to divert fluid flowing through the cooling core (24) past the cooler (66). The plate (46) with the cooler (66) attached is removable from the bottom tank (20) without disturbing the connections between the cooling core (24) and the bottom tank (20). The heat exchange structure is assembled in a picture frame mounting (12) with attaching members (16) passing through bottom members (17) of the picture frame mounting (12) and threading into fasteners (18) in the bottom tank (20) to removably anchor the picture frame mounting (12) and the heat exchange structure together.

15 Claims, 6 Drawing Figures

HEAT EXCHANGE STRUCTURE

DESCRIPTION

TECHNICAL FIELD

This invention relates to heat exchange structures and, more particularly, to the inclusion of a supplemental cooler in the downstream tank of a radiator cooling system.

BACKGROUND ART

In U.S. Pat. No. 2,397,069 to F. M. Young et al, issued Mar. 19, 1946, it was found to be desirable to have supplemental coolers for cooling selected fluids, such as transmission oil, and the like. Young et al recognized that a supplemental cooler could be piggybacked or tandemed onto the radiator cooling system. This arrangement had the problem of overstressing the joints between the parts of the cooling system causing leaks and failures. It also required that the cooling system had to be disassembled to service the supplemental heat exchanger. The added cooler added size to the structure making it unusable in certain applications.

In U.S. Pat. No. 2,796,239 to J. R. Holmes et al, issued June 18, 1957, another system was proposed wherein a separate cooler was mounted directly on the element itself, such as on the transmission housing, wherein cooling fluid was piped from the radiator to the cooler. This system had the disadvantage of the added cost for the extra cooler and piping plus the problems with leaky piping and the like.

U.S. Pat. No. 3,096,818 to H. W. Evans et al, issued July 9, 1963, shows an ebullient cooler wherein steam is admitted to the system for condensing. Engine oil is passed through the lower tank of the cooler to maintain the oil at a uniform temperature. A complex system of baffles, and the like, are provided particularly in the upper tank for condensing the steam and controlling the flow of the condensate.

DISCLOSURE OF INVENTION

The present invention is directed to overcoming one or more of the problems as set forth above.

A heat exchange structure is provided with a radiator having a downstream tank. Heated fluid is admitted to the radiator and flows through the radiator to the downstream tank. One side of said downstream tank is open and has a baffle mounted therein for diverting flow through said baffle. An oil cooler is mounted in the downstream tank whereby flow through the baffle flows over said oil cooler. A plate upon which said oil cooler is mounted is sealingly attached to the downstream tank to seal the downstream tank. An outlet is provided through the plate downstream from said baffle and oil cooler for exiting the fluid from said downstream tank.

Heretofore, sheet metal radiators had the platetype oil cooler soldered or brazed into the bottom tank. To replace the cooler required disassembly of the solder seals of the radiator. In addition, to replace the radiator also required replacing the cooler. The heavy mass of the cooler carried in the radiator tank could cause a high failure rate. The improved device has the cooler bolted into the radiator bottom tank making assembly, removal, and servicing simplified. The radiator can be replaced without replacing the oil cooler or the cooler can be replaced without replacing the radiator. The heavy mass of the cooler and the radiator are cradled in a rigid picture frame mounting thus eliminating the stress loading on the radiator by the cooler.

BEST MODE FOR CARRYING OUT THE INVENTION

Figure 1:
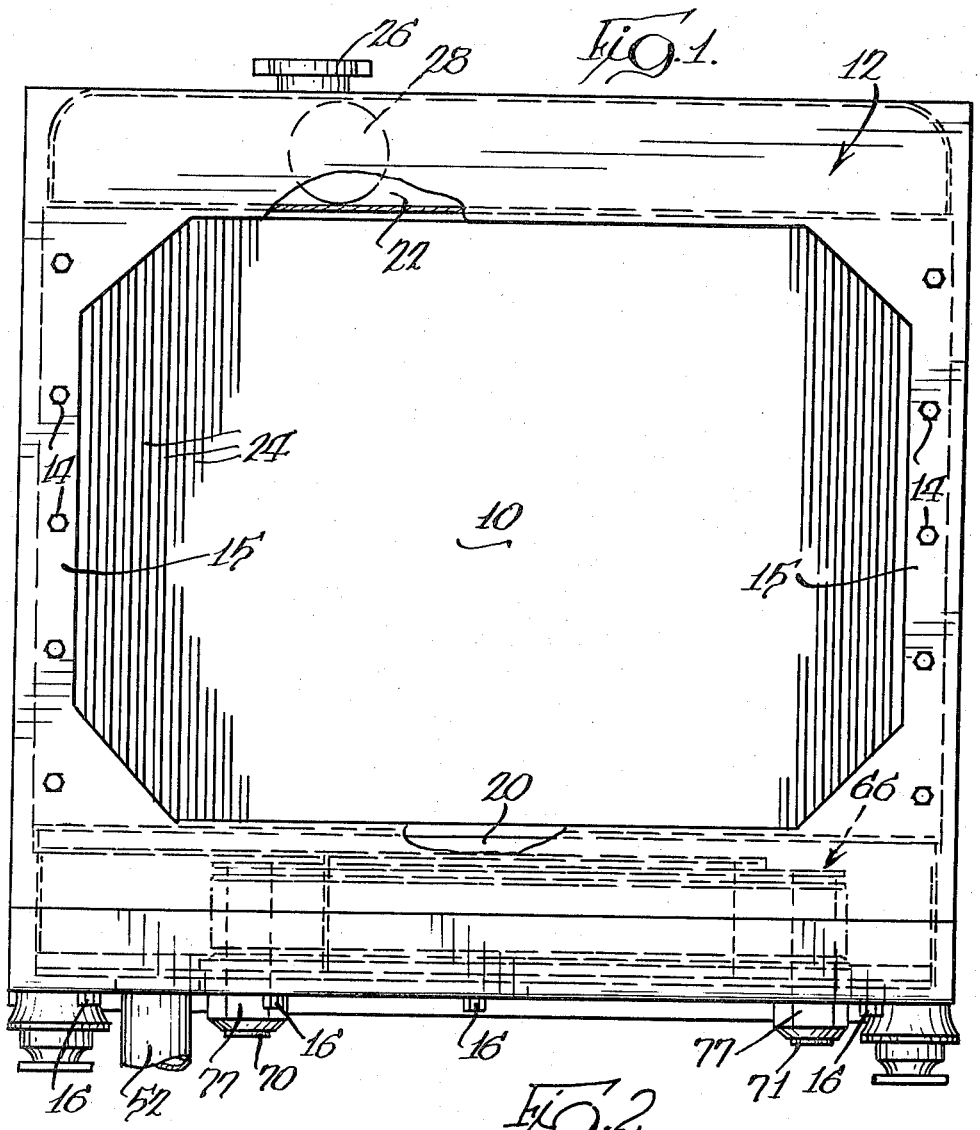
FIG. 1 is an elevational view of an embodiment of the present invention showing a radiator with a cooler mounted in a picture frame structure.

Referring to FIG. 1, a heat exchange structure is shown and is comprised of a radiator 10 nested in a picture frame mounting structure 12 and being secured therein not only by bolts 14 passing through the vertical corner channels 15 of the frame but also by bolts 16 passing through an L-shaped bottom member 17 of the picture frame structure 12. Said bolts 16 are threaded into fasteners 18 affixed in the bottom tank 20 of the radiator 10. The radiator 10 has a top tank 22 connected to said bottom tank 20 by a plurality of interconnecting cooling cores or tubes 24. A filler cap 26 communicates into the top tank 22 for adding fluid to the radiator 10. The top tank 22 has an inlet 28 connected into the top tank 22, through which inlet 28 heated cooling fluid from the engine passes into the top tank 22. The heated cooling fluid will flow into the top tank 22, through the cores or tubes 24 and into the bottom tank 20.

The bottom tank 20 is comprised of a sheet metal top tube plate 30 which may be copper, or the like, and through which the cores or tubes 24 from the core portion of the radiator 10 project into the bottom tank 20 and are soldered thereto. The tube plate 30 is crimped and soldered to a pair of spaced apart sidewalls 31 and 32 and a pair of end walls 33 and 34. Sidewalls 31 and 32 and the end walls 33 and 34 define an opening 35, which opening has a continuous collar 37 brazed or otherwise secured completely around the inside edge thereof. Said collar 37 has an open midportion 38 and has a plurality of said threaded fasteners 18 as well as a plurality of receptors 19 soldered, brazed or otherwise secured thereto. Each fastener 18 or receptor 19 is in alignment with one of a plurality of spaced apart openings 40 through said collar.

A plate 46, which in the preferred form shown is a bottom plate, is adapted to be sealingly bolted to the collar 37 with a gasket 42 therebetween. The plate 46 is secured to the collar 37 and hence to the bottom tank 20 by a plurality of bolts 50 which pass through apertures 51 in the plate 46 and through the openings 40 in the collar 37 and are threaded into the receptors 19. With the bolts 50 secured into the receptors 19, the bottom tank 20 of the radiator 10 is sealed except for the outlet nipple 52 secured near one end portion of the plate in alignment with an aperture 53 formed through said plate 46. The nipple 52 is connected to the radiator hose for carrying the cooling fluid from the radiator 10 at a reduced temperature back to the engine being cooled.

Figure 4:
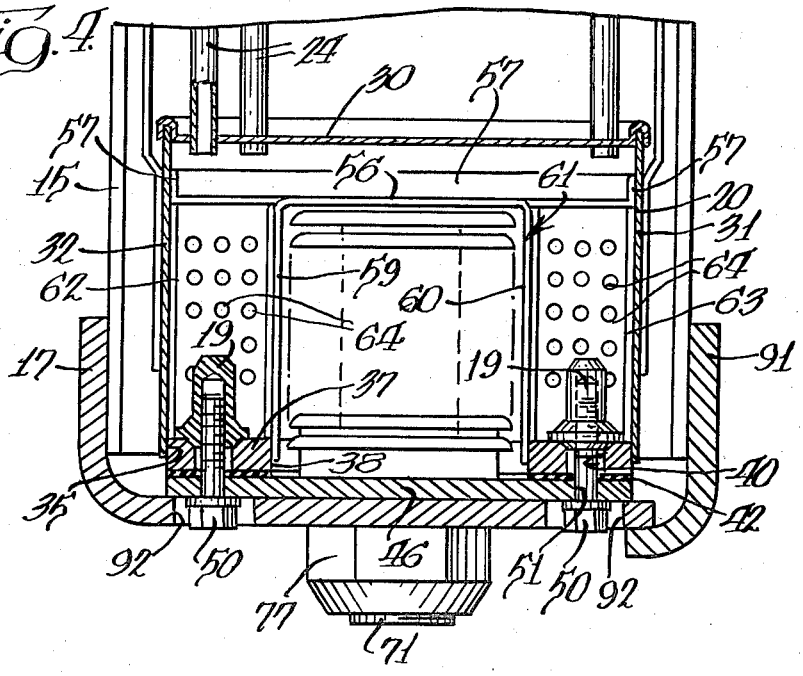
FIG. 4 is a cross-sectional view taken along the line 4—4 of FIG. 2.
Figure 5:
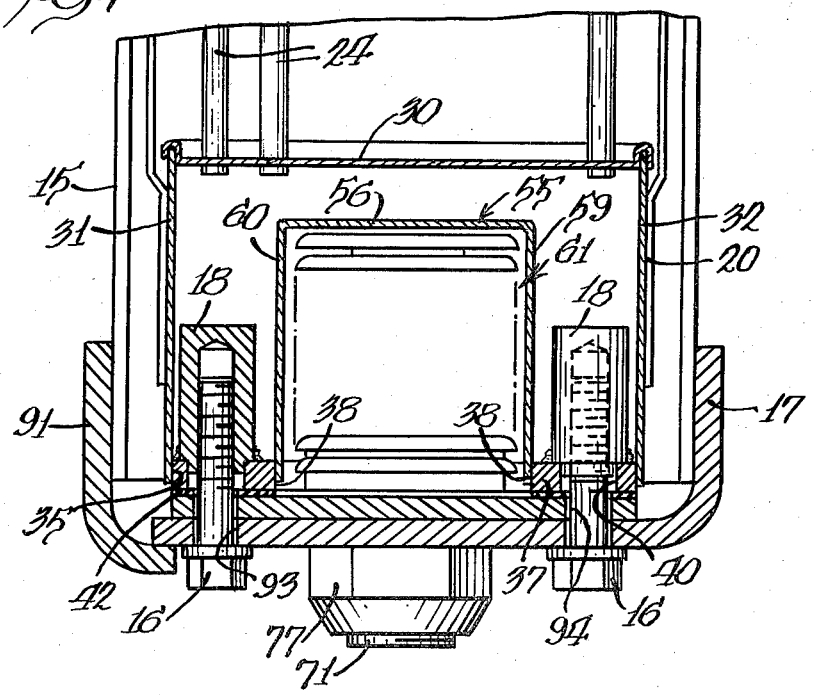
FIG. 5 is a cross-sectional view taken along the line 5—5 of FIG. 2.

As shown best in FIGS. 3 through 6, a baffle 55 is provided for the bottom tank 20 and consists of a planar surface portion or strip 56 of sheet metal, or the like, having at one end portion 54 thereof upturned flanges 57. The flanges 57 are adapted to be soldered, welded or otherwise secured to the inside of the end wall 33 and to the inside of the end portions of the sidewalls 31 and 32. The strip 56 of the baffle 55 has a reduced width at the other end portion 58 which extends some additional distance toward the opposite end wall 34 of the bottom tank 20 and has side portions 59 and 60 which extend downwardly into the opening 38 in the collar 37, as shown in FIGS. 4 and 5. The overlapping parts of the side portions 59 and 60 are soldered, or the like, to the edges of the opening 38. Shoulder-type baffles 62 and 63 are fit between the respective side portions 59 and 60 of the baffle 55 and the sidewalls 31 and 32 of the bottom tank 20 to close off free flow of fluid from between the side portions 59,60 and the sidewalls 31 and 32 of the bottom tank 20. The shoulder baffles 62 and 63 may have perforations 64 therethrough in varying numbers and sizes as the dictates of the system demand. The perforations 64 are provided in the shoulder baffles 62,63 to provide limited circulation through the pockets between the side portions 59 and 60 of the baffle 55 and the sidewalls 31 and 32 of the bottom tank 20. The baffle 55, when secured in position in the bottom tank 20, is such as to direct the fluid flowing through the cores or tubes 24 into the bottom tank 20 in a direction such that a large percentage of the fluid will flow through the channel 61 created by the end portion 58 of the strip 56, side portions 59 and 60 of the baffle 55 and the plate 46 bolted to said collar 37.

Mounted on the bottom plate 46 is a cooler 66, such as an oil transmission cooler, which is comprised of a plurality of tubes and radiating fins 68 lying substantially parallel to each other and lying substantially parallel to the strip 56 of the baffle 55. The cooler 66 is sealingly secured to the plate 46 by means of the inlet tube 70 and outlet tube 71 from the cooler 66 extending through openings 73 and 74 in the plate 46. Gaskets 75 and 76 are positioned around the inlet 70 and outlet 71 above and below the plate 46 whereupon nuts 77 are threaded onto the inlet 70 and outlet 71 to secure and to seal the cooler 66 to the plate 46. The plate 46, with the cooler 66 secured thereto and aligned with the opening 38 in the bottom tank 20, is moved toward the bottom tank to thread the cooler 66 into the bottom tank 20 and inside the channel 61 created by the strip 56 and side portions 59 and 60 of the baffle 55 until the plate engages the gasket 42 and the collar 37. Bolts 50 are passed through apertures 51 and 40 and are threaded into the receptors 19 such that when the bolts 50 are drawn up tight; the bottom plate 46 compresses the gasket 42 against the collar 37 to seal the bottom plate 46 to the bottom tank 20 with the cooler 66 nested in the bottom tank. The cooler 66 extends beyond the channel 61 of the baffle 55 in both directions, one end portion going into the unbaffled end portion of the bottom tank 20 and the other end portion going into the enlarged discharge end of the bottom tank.

Figure 2:
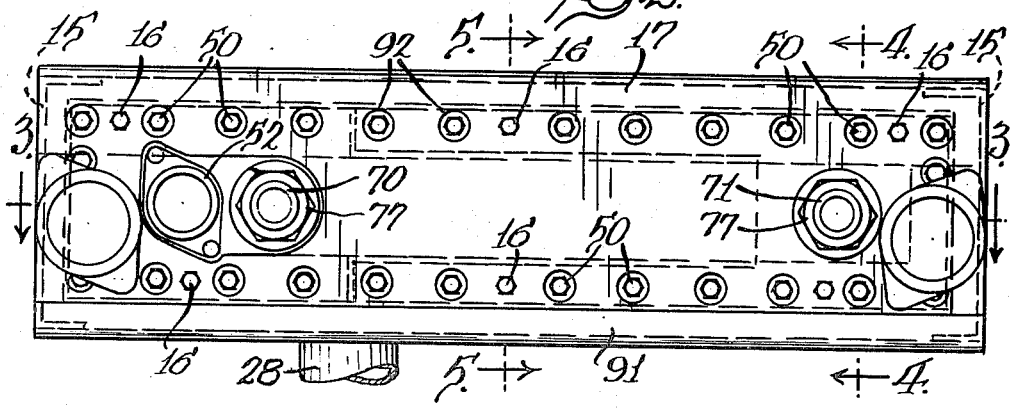
FIG. 2 is a bottom view of the embodiment of the radiator of FIG. 1.
Figures 3, 6:
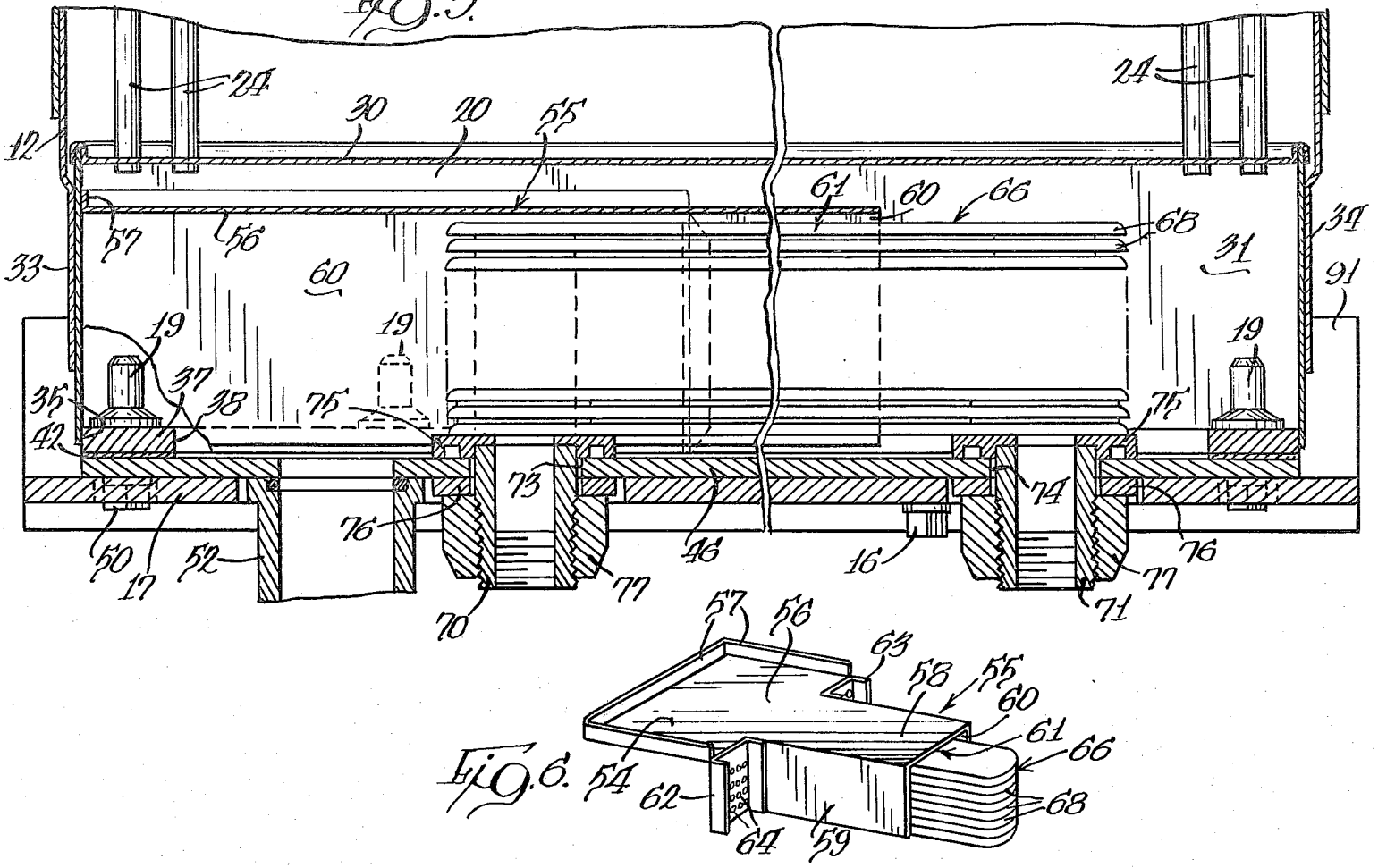
FIG. 3 is a cross-sectional view taken along the line 3—3 of FIG. 2.
FIG. 6 is a perspective view of the baffle and cooler of the invention removed from the bottom tank.

The picture frame structure 12 has four corner channels 15 which are connected to a box-like frame 85 at the top and are connected to a pair of overlapping L-shaped members 17 and 91 at the bottom. FIG. 4, which is a cross section taken along the line 4—4, looking in the direction of the arrows in FIG. 2, shows the L-shaped bottom member 17 fastened to the corner channels 15 on the front of the picture frame structure and extends down and across the bottom of the frame structure. The member 91 is connected to the opposite or rear corner channels 15 of the picture frame structure 12 and overlaps, and is attached to, the end portion of the member 17. The radiator 10, which is comprised of the top tank 22, the bottom tank 20 and the tubes or cores 24, with the plate 46 bolted thereto, is threaded into the opening in the top of the picture frame structure 12. It will be noticed in FIG. 4 that apertures 92 extend completely through the bottom member 17 of the picture frame structure 12 so that the heads of the bolts 50 nest in said apertures 92. FIG. 5, which is a cross-sectional view taken along the line 5—5 looking in the direction of the arrows of FIG. 2, is the reverse of FIG. 4 showing the L-shaped member 17 on the right-hand side and the L-shaped member 91 on the left-hand side. In this view, the bolts 16 pass through apertures 93 in the L-shaped member 17 and through apertures 94 in the plate 46 and are threaded into the fasteners 18 for bolting the picture frame structure 12 and the radiator 10 together. In the illustrated form, there are six bolts 16 which connect the picture frame structure 12 to the radiator 10 with the remaining bolts 50 being recessed in the apertures 92 in the L-shaped member 17 of the picture frame structure 12 which bolts 50 are used to secure the bottom plate 46 to the bottom tank 20 of the radiator 10. The inlet tube 70 of the cooler 66 is connected to the outlet for the oil in the transmission and the outlet 71 of the cooler 66 is connected to the inlet for the oil in the transmission so that the transmission oil is circulated from the downstream side of the cooler 66 through the cooler 66 and exits in a cooler condition from the outlet 71 and is pumped back to the transmission for recirculation. The radiator coolant flows from the top tank 22 through the cores 24 into the bottom tank 20 and is diverted by the baffle 55 so that all the coolant or fluid in the radiator 10 flows past the cooler 66 of the transmission. The pockets created between the side portions 59 and 60 of the baffle 55 and the sidewalls 31 and 32 of the tank are slowly flushed by means of the small perforations 64 through the shoulder baffles 62 and 63. In some applications, there will be no perforations in the shoulder baffles 62 and 63, while in other applications, there may be many perforations and of varying sizes, depending upon the problems that appear to develop in the system.

INDUSTRIAL APPLICABILITY

In use, a radiator 10 with the baffle 55 secured in the bottom tank 20 has an oil cooler 66 assembled in the bottom tank 20 by bolting the bottom plate 46 against the gasket 42 by means of bolts 50. This seals the bottom tank 20 except for the inlet 70 and outlet 71 to the cooler 66 and the outlet nipple 52 to the bottom tank 20. The radiator 10 is then threaded into the side channels 15 of the picture frame support structure 12 until the bottom plate 46 of the bottom tank 20 rests on the L-shaped member 17 of the picture frame structure 12. The radiator 10 is secured to the picture frame structure 12 by threading bolts 16 through the member 17 into the fasteners 18 in the radiator bottom tank. The cooler 66 may be connected to a transmission and the radiator 10 may be connected to an engine. All of the fluid coolant flowing through the radiator cores 24 is cooled by the passage of air therethrough whereupon the cooled fluid coolant will be diverted by the baffle 55 to flow past the cooler 66 with the fluid coolant picking up some heat from the heated fluid in the cooler 66. The cooling capabilities of the radiator 10 allows for the extra heat from the cooler 66. The hot transmission oil will flow counter to the flow of the fluid coolant in the bottom tank giving up heat to said coolant as it passes through said cooler 66.

The weight of the cooler 66 is supported by the picture frame mounting structure 12 as is the weight of the radiator 10 such that the weight of the cooler will not strain the joints in the radiator causing leakage problems. The radiator 10 and cooler 66 can be readily removed from the picture frame structure 12 for servicing either the radiator or the cooler. The radiator and cooler can be readily separated from each other for service or replacement of one or the other or both.

Other aspects, objects and advantages of this invention can be obtained from a study of the drawings, the disclosure and the appended claims.

I claim:

1. In a heat exchange structure comprising a radiator (10) having a downstream tank (20), means for admitting heated fluid to the radiator (10) wherein said fluid flows through the radiator (10) to the downstream tank (20), said downstream tank (20) has an opening (38) in one side thereof, baffle means (55) mounted in said downstream tank (20) for diverting flow from the radiator through said baffle means (55), and oil cooler (66) mounted in said downstream tank (20) in close association with said baffle means (55) whereby said flow through said baffle means (55) flows over said oil cooler (66), a plate (46) sealingly attached over said opening (38) in said downstream tank (20), and an outlet (52) in said downstream tank (20) downstream from said baffle means (55) and oil cooler (66) for exiting the fluid from said downstream tank (20).

2. In a heat exchange structure as claimed in claim 1 wherein said structure is nested in a frame (12) mounted on a vehicle, and fastening means (16) extend through said frame (12), through said plate (46) and into anchor means (18) in said tank (20) for securing said heat exchange structure to said frame.

3. In a heat exchange structure as claimed in claim 2 wherein said frame (12) embraces the four corners of the heat exchange structure so that said heat exchange structure can be threaded into and out of said frame (12) from above upon releasing said fastening means.

4. In a heat exchange structure as claimed in claim 1 wherein said baffle means (55) comprises a substantially planar surface portion (56) attached to one end wall (33) and two sidewalls (31,32) throughout a portion of the end-to-end length of said downstream tank (20), a reduced width portion (58) of said planar portion extending toward the other end (34) of the downstream tank (20), two sides (59,60) extending transverse to said reduced width portion (58) into sealing relation with said plate (46) to form a channel (61) in said downstream tank (20) in which channel (61) said oil cooler (66) is nested, shoulder baffles (62,63) extending between the downstream tank (20) and the two sides (59,60) of the baffle means (55) and extending from the planar surface (56) to the plate (46), and perforations (64) in said shoulder baffles (63,63) permitting limited flow of fluid outside said channel (61).

5. In a heat exchange structure as claimed in claim 4 wherein said oil cooler (66) comprises a plurality of radiating surfaces from a plurality of parallel tubes (68) extending from the inlet (70) to the outlet (71) of said oil cooler (66), said tubes (68) nesting in said channel (61) whereby the fluid flowing into the downstream tank (20) is diverted to said channel (61) so as to flow past the oil cooler (66) on the way to the fluid outlet (52) from the downstream tank (20).

6. In a heat exchange structure as claimed in claim 1 wherein said radiator (10) has a top tank (22) and a bundle of tubes (24) connected to said downstream tank (20), said downstream tank (20) is a bottom tank for receiving flow from said top tank (22) and from said tubes (24), said opening (38) in said bottom tank (20) is in the bottom thereof, and said plate (46) is a bottom plate secured over said opening (38) in said bottom tank (20).

7. In a heat exchange structure as claimed in claim 1 wherein said plate (46) supports said oil cooler (66) and has an inlet member (70) and an outlet member (71) for said oil cooler (66).

8. In a heat exchange structure as claimed in claim 7 wherein said plate (46) has an outlet (52) downstream from said oil cooler (66) for exiting fluid from said downstream tank (20).

9. In a heat exchange structure comprising a radiator (10) having a top tank (22), a bottom tank (20) and a bundle of tubes (24) extending between said top tank (22) and bottom tank (20), means for admitting heated fluid to the top tank (22) wherein said fluid flows through the top tank (22) and through the tubes (24) to the bottom tank (20), the bottom of said bottom tank (20) being open (38), a baffle means (55) mounted in said bottom tank (20) for diverting flow from said tubes (24) through said baffle means (55), a bottom plate (46) covering said open bottom (38) of the bottom tank (20), an oil cooler (66) mounted on said bottom plate (46) and projecting into said bottom tank (20) in line with said baffle means (55) whereby said flow through said baffle means (55) flows over said oil cooler (66), an oil inlet (70) and an oil outlet (71) passing through said plate (46) into and out of said oil cooler (66), means (50) for sealingly attaching said plate (46) to said bottom tank (20) to seal said bottom tank (20) closed, and an outlet (52) in said bottom plate (46) downstream from said baffle means (55) and oil cooler (66) for exiting the fluid from said bottom tank.

10. In a heat exchange structure as claimed in claim 9 wherein said last-named means (50) are bolts passing through the plate (46) into receptors (19) in the bottom tank (20) to secure said bottom plate (46) to said bottom tank (20).

11. In a heat exchange structure as claimed in claim 9 wherein said structure is nested in a frame (12) mounted on the vehicle, and fastening means (16) extend through said frame (12), said bottom plate (46) and into fasteners (18) in said bottom tank (20) for securing said heat exchange structure to said frame (12).

12. In a heat exchange structure as claimed in claim 11 wherein said frame (12) embraces the four corners of the heat exchange structure so that said heat exchange structure can be threaded into and out of said frame (12) from above upon releasing said fastening means (16).

13. In a heat exchange structure as claimed in claim 9 wherein said baffle means (55) comprises a substantially planar surface portion (56) attached to an end wall (33) and two sidewalls (31,32) throughout a portion of the length of said bottom tank (20), a reduced width portion (58) of said planar portion (56) extending toward an other end (34) of the bottom tank (20) and having two sides (59,60) extending downward into sealing relation with the bottom plate (46) to form a channel (61) through said baffle (55).

14. In a heat exchange structure as claimed in claim 13 wherein shoulder baffles (62,63) extend between the sidewalls (31,32) and the two sides (59,60) of the baffle means (55) and extend from the planar surface (56) to the bottom plate (46) and wherein perforations (64) are formed in said shoulder baffles (62,63) for permitting fluid to flow to the outlet (52) of the bottom tank (20) without flowing through said channel (61).

15. In a heat exchange structure as claimed in claim 13 wherein said oil cooler (66) comprises a plurality of radiating surfaces from a plurality of parallel tubes (68) extending from the inlet (70) to the outlet (71) of said oil cooler (66), said tubes (68) nesting in said channel (61) defined by said reduced width portion (58) and the two sides (59,60) of the baffle means (55) whereby the fluid flowing from the tubes (68) into the bottom tank (20) is diverted to said channel (61) by said baffle means (55) so as to flow past the oil cooler (66) on the way to the fluid outlet (52) from the bottom tank (20).

* * * * *